US011355267B2

(12) United States Patent
Kawase

(10) Patent No.: US 11,355,267 B2
(45) Date of Patent: Jun. 7, 2022

(54) WIRE HARNESS PRODUCING DEVICE

(71) Applicant: Hitachi Metals, Ltd., Tokyo (JP)

(72) Inventor: Kenji Kawase, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 16/865,002

(22) Filed: May 1, 2020

(65) Prior Publication Data

US 2020/0357542 A1 Nov. 12, 2020

(30) Foreign Application Priority Data

May 10, 2019 (JP) ..... JP2019-089966

(51) Int. Cl.
*H01B 13/012* (2006.01)

(52) U.S. Cl.
CPC . *H01B 13/01209* (2013.01); *H01B 13/01245* (2013.01)

(58) Field of Classification Search
CPC ..... H01B 13/01209; H01B 13/01245; H01B 13/01236
See application file for complete search history.

(56) References Cited

U.S. PATENT DOCUMENTS 5,016,345 A * 5/1991 Aligue ..... H01R 43/28 211/60.1
6,101,695 A * 8/2000 Nakamura ..... H01R 43/052 29/33 M (Continued)

FOREIGN PATENT DOCUMENTS

CN 107255996 B * 7/2019 ..... H01B 13/012
EP 3 065 145 A1 9/2016

(Continued)

OTHER PUBLICATIONS

Extended European Search Report dated Aug. 13, 2020 for European Patent Application No. 20172839.1-1201.

(Continued)

*Primary Examiner* — Peter Dungba Vo
*Assistant Examiner* — Jose K Abraham
(74) *Attorney, Agent, or Firm* — McGinn I.P. Law Group, PLLC.

(57) ABSTRACT

A wire harness producing device configured to produce a wire harness by displaying a wire laying-out drawing in a full size in a length direction on a plurality of display devices, and laying-out electric wires along the wire laying-out drawing. The device includes a displaying control section configured to look up operation recipe information configured as a database capable of identifying wire laying-out order numbers of the electric wires, and in turn display wire laying-out position indicators configured to indicate positions of the electric wires to be laid out, on the plurality of display devices, according to a wire laying-out order of the electric wires. The operation recipe information includes coordinate information for indicating displaying positions for the wire laying-out position indicators. The displaying control section is configured to display the wire laying-out position indicators, in the displaying positions indicated by the coordinate information on the plurality of display devices.

8 Claims, 12 Drawing Sheets

(56) References Cited

U.S. PATENT DOCUMENTS

| | | | | |
|---|---|---|---|---|
| 6,658,312 | B1 * | 12/2003 | Hagiyama | H01R 43/28 29/33 F |
| 10,296,818 | B1 * | 5/2019 | Bigbee, Jr | H01B 13/345 |
| 2013/0100277 | A1 * | 4/2013 | Prieto Loefkrantz | G06F 3/011 348/87 |
| 2015/0241473 | A1 | 8/2015 | Hötz Ordoño et al. | |
| 2016/0064121 | A1 * | 3/2016 | Rougier | H01B 13/01236 29/868 |
| 2017/0235870 | A1 * | 8/2017 | Koppauer | G06T 19/20 703/1 |
| 2018/0088550 | A1 * | 3/2018 | Kawase | B23D 33/006 |
| 2020/0020465 | A1 | 1/2020 | Kawase et al. | |
| 2020/0168368 | A1 | 5/2020 | Kawase et al. | |

FOREIGN PATENT DOCUMENTS

| | | | | |
|---|---|---|---|---|
| EP | 3 301 688 | A1 | 4/2018 | |
| EP | 3 594 971 | A1 | 1/2020 | |
| JP | 2017157561 | A * | 9/2017 | G09B 23/183 |

OTHER PUBLICATIONS

European Office Action, dated Oct. 6, 2021, in European Application No. 20 172 839.1 (English Version).

Projection Works: "Wire harness assembly with projected work instructions", May 11, 2017 (May 11, 2017), p. 1, XP054982307, Retrieved from the Internet: URL:https://www.youtube.com/watch?v=nIT2w082mrc[retrieved on Jan. 10, 2021].

* cited by examiner

FIG. 3

172

| Step No. | ... | FROM | | | | ... | TO | | | | ... | Cable name | Cut Length | Cable P/N No. | X-From | Y-From | X-To | Y-To | ... |
|---|---|---|---|---|---|---|---|---|---|---|---|---|---|---|---|---|---|---|---|
| | | Side | Side Label Character | Ring mark | ... | | Ring mark | Side Label Character | Side | ... | | | | | | | | | |
| 1 | | | | | | | | | | | | | | | | | | | |
| 2 | | | | | | | | | | | | | | | | | | | |
| 3 | | | | | | | | | | | | | | | | | | | |
| 4 | | | | | | | | | | | | | | | | | | | |
| 5 | | | | | | | | | | | | | | | | | | | |
| ... | | | | | | | | | | | | | | | | | | | |

174

FIG. 12

Scan Traceability Report

Part Number : EH*****
Production Id : 681** / 34* / ******
Operators : 1.aaaa 2.bbbb 3.cccc
Total 1h 33s Version 01 / 0003
Start 2019/03/04 11:51

Drawing No. ******
Finish 2019/03/04 12:52

File ****
Line Line4

Scanned Data

| Side | Item/Operation | Date | Additional Info | Length | Scanned | Time[s] | More Info |
|---|---|---|---|---|---|---|---|
| | Process | 2019/03/04 12:52 | | | ***Finish*** | | |
| | Process | 2019/03/04 12:36 | Inspection | | Finish | 321 | |
| | Process | 2019/03/04 12:31 | Inspection | | Start | | |
| | ⋮ | ⋮ | ⋮ | | ⋮ | | |
| C | A:50MN15C | 2019/03/04 12:14 | Wire Conductivity | 5510 | 1.0515E+00 | 30/30 | |
| C | A:50MN15C | 2019/03/04 12:13 | CAB-***-**** | 5510 | | 9 | |
| C | A:50MN15C | 2019/03/04 12:13 | CAB-***-**** | 5510 | | | |
| C | A:50MN15C | 2019/03/04 12:13 | CAB-***-**** | 5510 | Scan | | |
| | ⋮ | ⋮ | ⋮ | | ⋮ | | |

WIRE HARNESS PRODUCING DEVICE

CROSS-REFERENCE TO RELATED APPLICATION

The present application is based on Japanese patent application No. 2019-089966 filed on May 10, 2019, the entire contents of which are incorporated herein by reference.

BACKGROUND OF THE INVENTION

1. Field of the Invention

The present invention relates to a wire harness producing device.

2. Description of the Related Art

A wire harness designed to be used in a train vehicle such as a train or the like is configured with a plurality of electric wires being bundled together therein. In producing the wire harness, the wire harness is assembled by cutting each of the plurality of electric wires to a preset electric wire length, laying them out along a full scale wire laying out drawing, and fitting the laid out electric wires or the bundle of the laid out electric wires with a component to be attached at a predetermined position thereon (see e.g. US Patent Application Publication No. 2016/0064121 A1).

US Patent Application Publication No. 2016/0064121 A1 discloses a method of displaying a full scale wire laying out drawing (a full scale wire laying out image) on a display, and laying out electric wires along the wire laying out image.

[Patent Document 1] US Patent Application Publication No. 2016/0064121 A1

SUMMARY OF THE INVENTION

The wire harness configured to be used in a train vehicle such as a train or the like is constituted by using a large number of electric wires. For that reason, in order to reduce the occurrence of an incorrect operation such as an incorrect wiring or the like, guiding the operation, supporting the operator, and enhancing the operation efficiency is desired.

Accordingly, it is an object of the present invention to provide a wire harness producing device, that is designed to ensure the improvement of the operation efficiency in wire laying out operation and the like.

For the purpose of solving the above-described problems, the present invention provides a wire harness producing device, which is configured to produce a wire harness by displaying a wire laying out drawing in a full size in a length direction on a plurality of display devices, and laying out electric wires along the wire laying out drawing, the device comprising a displaying control section configured to look up operation recipe information configured as a database capable of identifying wire laying out order numbers of the electric wires, and in turn display wire laying out position indicators configured to indicate positions of the electric wires to be laid out, on the plurality of display devices, in accordance with a wire laying out order of the electric wires, with the operation recipe information including coordinate information for indicating displaying positions for the wire laying out position indicators, with the displaying control section configured to display the wire laying out position indicators, in the displaying positions indicated by the coordinate information on the plurality of display devices.

Points of the Invention

According to the present invention, it is possible to provide the wire harness producing device, that is designed to ensure the improvement of the operation efficiency in wire laying out operation and the like.

BRIEF DESCRIPTION OF THE DRAWINGS

FIG. 3 is a diagram showing one example of operation recipe information.

FIG. 12 is a diagram showing one example of operation history information.

DETAILED DESCRIPTION OF THE PREFERRED EMBODIMENTS

Embodiment

An embodiment of the present invention will be described below in conjunction with the accompanying drawing.

Figure 1:
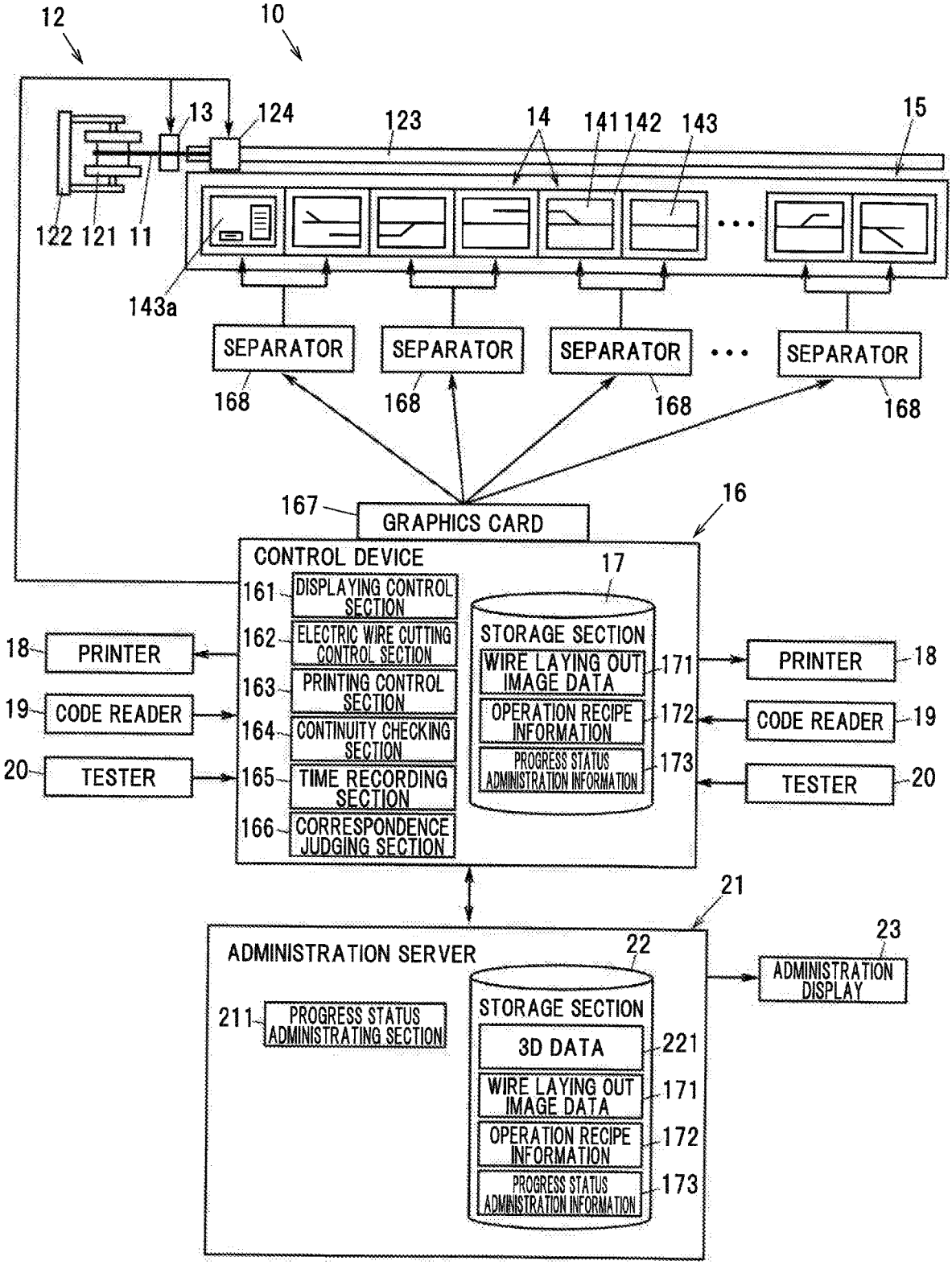
FIG. 1 is a schematic configuration diagram of a wire harness producing device according to one embodiment of the present invention.

FIG. 1 is a schematic configuration diagram of a wire harness producing device 10 according to the present embodiment. A wire harness to be produced in the present embodiment is designed to be used in, e.g., wiring between devices in a train.

As shown in FIG. 1, the wire harness producing device 10 is a device designed to produce the wire harness by arranging a plurality of display devices 14 end to end, each configured to include a display portion 141 and a bezel portion 142 arranged around a periphery of the display portion 141, displaying a wire laying out drawing (a wire laying out image) 143 in a full size on the plurality of display devices 14, and laying out an electric wire 11 along the wire laying out drawing 143.

The wire harness producing device 10 is configured to include an electric wire feeding device 12, an electric wire cutting machine 13, which is configured to cut the electric wire 11 fed from the electric wire feeding device 12, a work bench 15, which is composed of the plurality of display devices 14 arranged end to end, and a control device 16, which is configured to perform a control on the electric wire feeding device 12 and the electric wire cutting machine 13, and a displaying control on the plurality of display devices 14, and the like.

The electric wire 11 is configured as a linear shape conductor coated with an electrical insulating member around its outer periphery, but that electric wire 11 may, as with a LAN cable, integrally be configured in such a manner that a plurality of the linear shape conductors are coated with the electrical insulating members around their outer peripheries respectively, and then covered together with an outer sheath therearound. Here, the electrical insulating members are made of an electrically insulative resin and may be configured as one layer or a plurality of layers. The outer sheath may be formed by solid extrusion in such a manner as to impregnate the spaces between the electrical insulating members, or may be formed in a tubular shape.

The electric wire feeding device 12 is configured to include a reel 121 with the electric wire 11 being wound therearound, a supporting member 122, which is configured to pivotably support the reel 121, and a transfer robot 124, which is configured to hold that electric wire 11 fed from the reel 121, run on a rail 123, and transfer (pull out) that electric wire 11. The reel 121 is fitted with an electric wire identification code (not shown), which is configured to identify a type of the electric wire 11 being wound therearound. The rail 123 is configured to be provided above the work bench 15, and being fixed to the work bench 15.

The electric wire cutting machine 13 is configured to use a built-in cutting blade (not shown), to cut that electric wire 11 pulled out by the transfer robot 124. The type of the electric wire 11 to be laid out can be altered by altering the reel 121 supported by the supporting member 122. A feeder, though not shown, is provided in the subsequent stage of the reel 121, and the length of the electric wire 11 pulled out by that feeder is measured. Note that the electric wire feeding device 12 may not be provided with the transfer robot 124, and that the electric wire 11 fed out from the feeder may be pulled out by human hand. Further, no feeder may be provided, and the electric wire 11 may be pulled out from the reel 121 by human hand.

The work bench 15 is configured as a bench designed for a wire laying out operation for the electric wire 11 to be performed thereon, and being provided with the plurality of display devices 14 on its top surface, for displaying a full scale wire laying out image. Since the wire harness for a train vehicle is very long, e.g., 30 m, the work bench 15 is constituted by arranging the plurality of display devices 14 end to end in one row. Herein, the work bench 15 is constituted by arranging 24 of the display devices 14 end to end in one row. Note that the number of the display devices 14 to be arranged end to end on the work bench 15 is not limited to the above number. Also, the arrangement of the plurality of display devices 14 is not limited to the illustrated one, but can appropriately be altered according to the shape of the wire harness to be produced. For example, the plurality of display devices 14 may be arranged in rows and columns in a matrix.

Figure 2A:
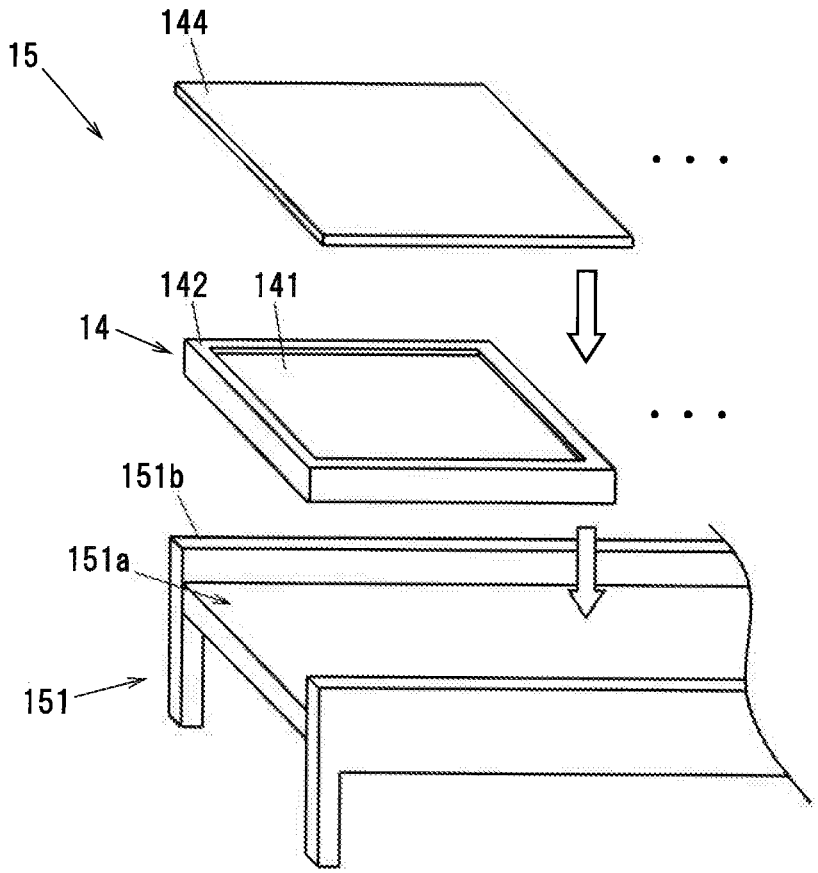
FIG. 2A is an exploded perspective view showing a work bench.
Figure 2B:
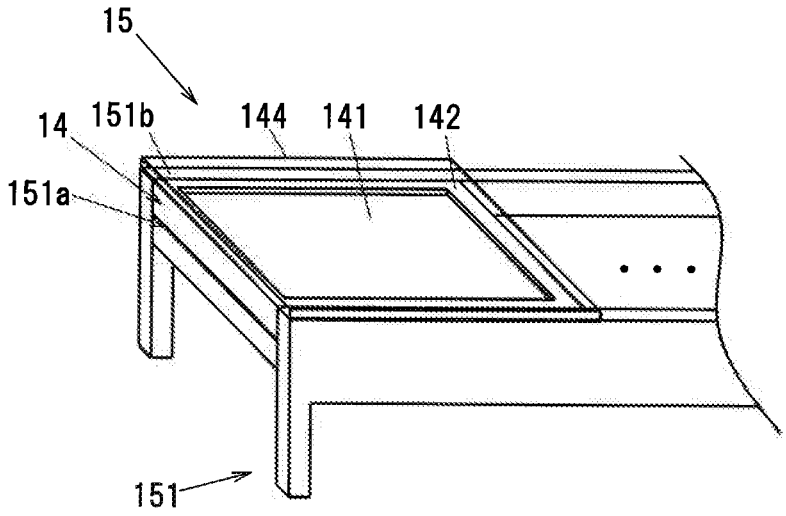
FIG. 2B is a perspective view showing the work bench.

The plurality of display devices 14 are made of, e.g., a liquid crystal display or the like. As shown in FIGS. 2A and 2B, the work bench 15 has a frame 151 having a recessed receiving portion 151*a* for the plurality of display devices 14 to be set therein, and is constituted by the plurality of display devices 14 being received in the receiving portion 151*a* from above the frame 151. Plate-shape transparent protecting covers 144 are provided on the plurality of display devices 14, respectively, to protect the respective display portions 141 of the plurality of display devices 14. The transparent protecting covers 144 are made of a transparent member such as an acrylic or the like. A wire harness production is performed by laying out the electric wire 11 cut by the electric wire cutting machine 13 on the transparent protecting covers 144 in such a manner as to allow the electric wire 11 to follow the wire laying out drawing 143 displayed on the plurality of display devices 14, and subsequently appropriately performing tape wrapping, protective material mounting, and the like.

The transparent protecting covers 144 are provided on the plurality of display devices 14, respectively, in such a manner as to cover uneven surfaces between the respective display portions 141 and the respective bezel portions 142 of the plurality of display devices 14. The transparent protecting covers 144 serve to protect the respective display portions 141 of the plurality of display devices 14 from being damaged, and to substantially prevent the electric wire 11 to be laid out from being damaged due to interfering with the uneven surfaces between the respective display portions 141 and the respective bezel portions 142 of the plurality of display devices 14.

The plurality of display devices 14 may be provided with one transparent protecting cover 144, but in this case, in the event of damage to the one transparent protecting cover 144, replacing the one transparent protecting cover 144 is wasteful, or in the event of a fault in the display devices 14, replacing the display devices 14 is time consuming. In light of the foregoing, in the present embodiment, the transparent protecting covers 144 are each individually being provided for each of the plurality of display devices 14. The transparent protecting covers 144 can be detached upward from the display devices 14. By detaching the transparent protecting covers 144 from the display devices 14, the display devices 14 can also be detached upward from the frame 151 of the work bench 15. Thus, even when the work space is narrow, the transparent protecting covers 144 or the display devices 14 can easily be replaced. Note that even when the plurality of display devices 14 are arranged in a matrix, the transparent protecting covers 144 can be applied thereto.

The lengths of the transparent protecting covers 144 in a direction of the arrangement of the plurality of display devices 14 arranged end to end in one row are configured to be substantially equal to those of the plurality of display devices 14. Further, the widths of the transparent protecting covers 144 in a width direction perpendicular to the direction of the arrangement of the plurality of display devices 14 arranged end to end in one row are configured to be slightly larger than those of the plurality of display devices 14. The transparent protecting covers 144 are fixed to the frame 151 of the work bench 15 by fixing respective two projecting end portions of the transparent protecting covers 144 being projected from the plurality of display devices 14 in the width direction of the plurality of display devices 14 to two edge portions 151*b* of the frame 151 with screws or the like. Note that the transparent protecting covers 144 for the plurality of display devices 14 may or may not be contiguous to the respective bezel portions 142 of the plurality of display devices 14.

It is desirable that joined portions between adjacent ones of the transparent protecting covers 144 for the plurality of display devices 14 be located on the respective bezel portions 142 of the plurality of display devices 14. This is because if the joined portions between the adjacent ones of the transparent protecting covers 144 lie on the respective display portions 141 of the plurality of display devices 14, it may be difficult to read in a code with a code reader 19, which will be described later. In addition, a transparent protective tape may be provided on the joined portions between the adjacent ones of the transparent protecting covers 144. The protective tape is configured to play a role in substantially preventing the electric wire 11 to be laid out from being damaged due to interference with the end portions of the transparent protecting covers 144, in the event of an uneven surface formation at the joined portions between the adjacent ones of the transparent protecting covers 144 due to a manufacturing tolerance or the like, or in the event of the end portions of the transparent protecting covers 144 being separated from each other for some reason.

In order to suppress the eyestrain of an operator, the transparent protecting covers 144 for the plurality of display devices 14 may each be configured in such a manner as to include a blue light blocking layer that attenuates or blocks blue light having a wavelength of 380 nm to 500 nm. Further, the transparent protecting covers 144 may each be configured in such a manner as to include on their surfaces a reflection suppressing layer for suppressing the occurrence of reflected glare of external lighting or the like.

The control device 16 is configured to include a storing section 17 that is configured to store wire laying out image data 171, operation recipe information 172, and the like. The wire laying out image data 171 is designed as image data for the wire laying out drawing 143 to be displayed on the plurality of display devices 14. The operation recipe information 172 is designed as a database with wire laying out order numbers of the electric wires 11 being time series ordered therein. In other words, the operation recipe information 172 is a database of each kind of information on all of the electric wires 11 to be laid out having been sorted in an order in which those electric wires 11 are to be laid out. Note that the present invention is not limited to the foregoing, but that the wire laying out order numbers may be stored in that database for each of the electric wires 11, and that it is not essential that each kind of information on all of the electric wires 11 to be laid out is sorted in the wire laying out order of the electric wires 11 within the database.

As shown in FIG. 3, in the operation recipe information 172, for each one of the electric wires 11 to be laid out, for example, a name (Cable name) of each one of the electric wires 11, an electric wire length design value (Cut Length) of each one of the electric wires 11, and a production number (Cable P/N No.) for denoting a type of each one of the electric wires 11 are configured. Further, in the operation recipe information 172, for example, for each of respective two end portions (From and To) of each one of the electric wires 11 to be laid out, a ring mark number (Ring mark) of each one of the electric wires 11 which will be described later, a side (Side) for indicating a position of one or the other of the respective two end portions of each one of the electric wires 11 and denoting a connection destination area (e.g., a connection destination device or the like) of each one of the electric wires 11, and the like are configured.

Further, in the present embodiment, the operation recipe information 172 is configured to include coordinate information for indicating two displaying positions for a wire laying out position indicator (an identification code), which will be described later, for each one of the electric wires 11 to be laid out. The operation recipe information 172 is configured to include two pieces of the coordinate information of the vicinities of the respective two end portions of each one of the electric wires 11 to be laid out. An X-From and a Y-From in FIG. 3 denote an X coordinate and a Y coordinate respectively showing the respective wire laying out position indicator (identification code) displaying position adjacent to one of the respective two end portions of each one of the electric wires 11 to be laid out. An X-To and a Y-To in FIG. 3 denote an X coordinate and a Y coordinate respectively showing the respective wire laying out position indicator (identification code) displaying position adjacent to the other one of the respective two end portions of each one of the electric wires 11 to be laid out. Note that the specific contents of the operation recipe information 172 are not limited to the foregoing, but can appropriately be configured.

The control device 16 is configured to include a displaying control section 161, which is configured to perform a displaying control on the plurality of display devices 14 of the work bench 15, an electric wire cutting control section 162, which is configured to perform a cutting control on those electric wires 11, a printing control section 163, which is configured to print, with two printers 18, identification marks to be attached to the respective two end portions respectively of each one of those electric wires 11, and a continuity checking section 164 that is configured to perform a continuity checking processing on each one of those electric wires 11. The control device 16 is configured in such a manner that the plurality of display devices 14 of the work bench 15, two code readers 19, the transfer robot 124, the electric wire cutting machine 13, the two printers 18, and two continuity checking testers 20 are connected to the control device 16.

The displaying control section 161 of the control device 16 is configured to display the full scale wire laying out drawing 143 on each of the plurality of display devices 14 of the work bench 15, on the basis of the wire laying out image data 171 stored in the storing section 17 of the control device 16. The wire laying out image data 171 output from the displaying control section 161 is separated by means of graphics cards 167 into every two of the display devices 14, and the separated image data 171 are further separated into two each by means of separators 168 and displayed on the respective display portion 141 of each of the plurality of display devices 14.

In addition, in the present embodiment, the displaying control section 161 of the control device 16 is configured to look up the operation recipe information 172, and in turn display the wire laying out position indicators on the plurality of display devices 14 of the work bench 15 in accordance with the wire laying out order of the electric wires 11. In addition, the displaying control section 161 of the control device 16 is configured to erase the display of the wire laying out position indicators associated with the electric wires 11 having been laid out. That is, the displaying control section 161 of the control device 16 is configured to display only the wire laying out position indicator for the electric wire 11 currently being laid out. The wire laying out position indicators refer to the indicators configured to indicate to the operator the positions of the electric wires 11 to be laid out.

Figure 4A:
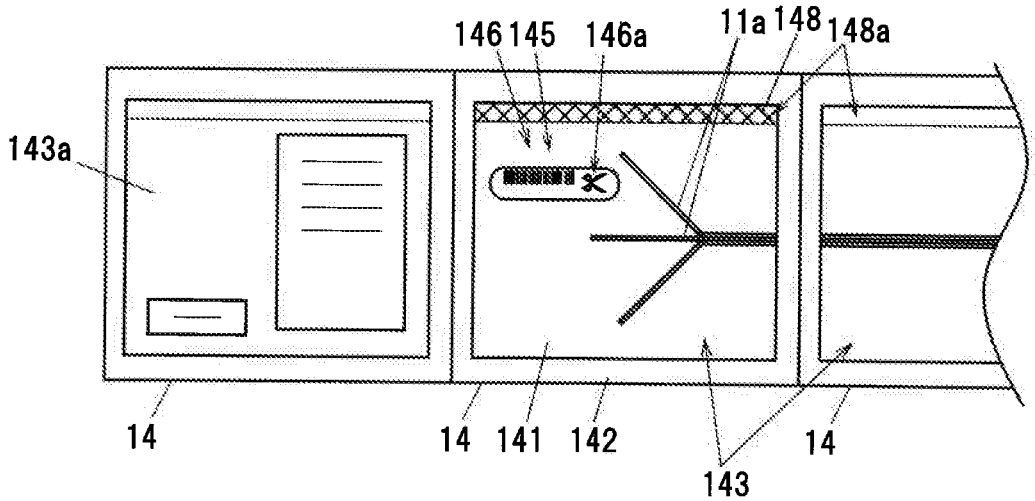
FIG. 4A is a diagram showing a display example on display devices.
Figure 4B:
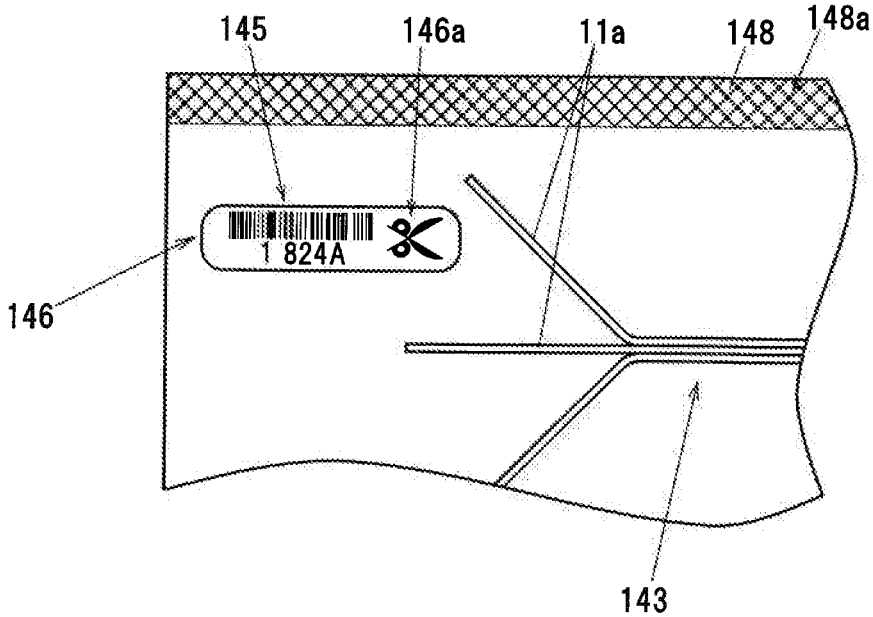
FIG. 4B is an enlarged view of an essential portion of the display example shown in FIG. 4A.

As shown in FIGS. 4A and 4B, in the present embodiment, the wire laying out position indicators 145 are each being configured to include a bar code 146 as the respective identification code of each of the electric wires 11 to be laid out. The displaying control section 161 of the control device 16 is configured to create the respective bar code (respective pop-up bar code) 146 configured to be able to identify each of those electric wires 11 to be laid out, and display that created respective bar code 146 on the plurality of display devices 14 of the work bench 15. The respective bar code 146 is configured to be created from character information in the operation recipe information 172, for example, number information in a ring mark. Also, the respective bar code 146 may be configured in such a manner as to be created from other information included in the operation recipe information 172, and may be configured in such a manner as to include a plurality of pieces of information. The displaying control section 161 of the control device 16 is configured to look up the operation recipe information 172, and display the respective wire laying out position indicator 145 including the respective bar code 146 thereon of each of those electric wires 11 to be laid out, in the two displaying positions indicated by the coordinate information in the operation recipe information 172, in such a manner as to allow the wire laying out position indicator 145 to be superimposed on the wire laying out drawing 143.

The wire laying out drawing 143 is configured to include electric wire images 11*a* of a plurality of the laid out electric wires 11. Since those electric wires 11 have their two end portions, in the present embodiment, the operation recipe information 172 is configured to include the two pieces of the coordinate information therein in correspondence with the respective two end portions, respectively, of each of those electric wires 11. The displaying control section 161 of the control device 16 is configured to display the two wire laying out position indicators 145 for each one of those electric wires 11, in the two displaying positions indicated by the two pieces of the coordinate information in the operation recipe information 172, that is, in the two displaying positions adjacent to the respective two end portions, respectively, of that one of those electric wires 11 on the wire laying out drawing 143.

Note that the displaying control section 161 of the control device 16 may be configured in such a manner as to prestore in the operation recipe information 172 the image information in the respective two bar codes 146 of each of those electric wires 11 to be laid out, and act to retrieve that image information in the respective two bar codes 146 and display the respective two wire laying out position indicators 145 including the respective two bar codes 146 thereon on the designated coordinates. Further, the identification codes to be included in the respective two wire laying out position indicators 145 of each of those electric wires 11 to be laid out are not limited to the bar codes 146, but may be, e.g., a two-dimensional code (a QR code (registered trademark)).

Note that it is not essential that the wire laying out position indicators 145 include the identification codes (the bar codes 146), but that the wire laying out position indicators 145 may be composed of a mark such as an arrow or the like, an icon, a character, and the like. Although details will be described later, in the present embodiment, reading in the identification codes (the bar codes 146) is used as a trigger for operation start or operation finish, but when no identification code is included in the wire laying out position indicators 145, the plurality of display devices 14 can be configured with a touch panel, for example, so that the operation start or the operation finish can be triggered by the operator touching the wire laying out position indicators 145. Further, an input device such as a switch, or a mouse, or a keyboard or the like connected to the control device 16 may be used so that the trigger for the operation start or the operation finish can be input to the control device 16 by that input device.

The wire laying out drawing 143 is displayed on the plurality of display devices 14 of the work bench 15 in such a manner that the lengths of those electric wires 11 (the lengths of the electric wire images 11*a*) on the wire laying out drawing 143 are the full scale lengths of those electric wires 11. Note that the thicknesses of the electric wire images 11*a* may be thicker or thinner than the full scale thicknesses of the electric wires 11. By displaying the electric wire images 11*a* thicker than the full scale thicknesses of the electric wires 11, when the electric wires 11 are laid out, the electric wire images 11*a* thereof are substantially prevented from being hidden by those electric wires 11, and so the wire laying out operation is facilitated.

Figure 4C:
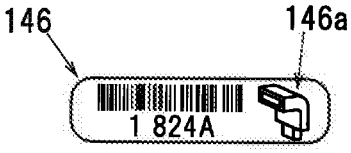
FIG. 4C is a diagram showing another example of an icon.

Furthermore, in the present embodiment, the wire laying out position indicators 145 are each being configured to include thereon a icon 146*a* indicating an operation content. The displaying control section 161 of the control device 16 is configured to display the bar codes 146 as the identification codes and the icons 146*a* as the wire laying out position indicators 145 indicating the operation content adjacent to those bar codes 146. For example, the icon 146*a* which depicts scissors as shown in FIGS. 4A and 4B denotes an electric wire 11 feeding and cutting operation, and indicates that when the bar code 146 has been read in by the code reader 19, the electric wire 11 feeding and cutting is performed. Further, the icon 146*a* which depicts the code reader 19 as shown in FIG. 4C serves as an indicator requiring the wire laying out to be followed by reading in the bar code 146 with the code reader 19. By displaying the icon 146*a* indicating the operation content along with the bar code 146, it is possible for the operator to intuitively decide on the operation to be performed, which results in a contribution to an enhancement in operation efficiency.

Figure 5A:
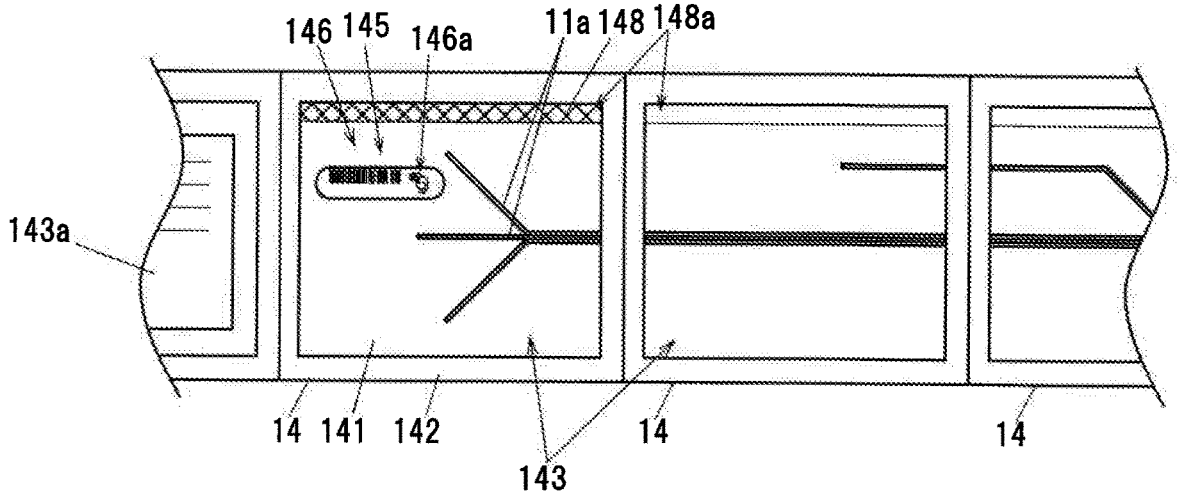
FIGS. 5A to 5C are diagrams for explaining a guide indicator.
Figure 5B:
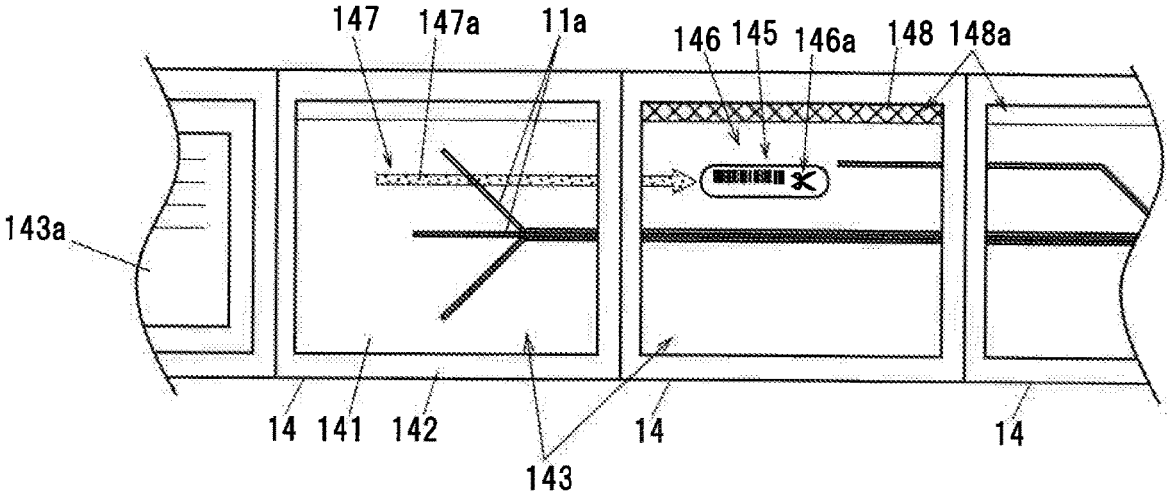

Furthermore, in the present embodiment, the displaying control section 161 of the control device 16 is configured in such a manner that when switching the display of the wire laying out position indicators 145, that displaying control section 161 erases the current wire laying out position indicators 145 while displaying the next wire laying out position indicators 145, and displaying guide indicators for indicating to the operator the displaying positions for the next wire laying out position indicators 145. For example, when the wire laying out operation for the electric wires 11 has been completed in the state of FIG. 5A and when the bar code 146 has been read in with the code reader 19, as shown in FIG. 5B, the current wire laying out position indicator 145 is erased and the wire laying out position indicator 145 is displayed adjacent to the end portion of the electric wire 11 to be next laid out. At this point of time, in the present embodiment, an arrow 147*a*, which is extending from the displaying position for the erased wire laying out position indicator 145 to the displaying position for the next wire laying out position indicator 145, is displayed as the guide indicator 147.

Figure 5C:
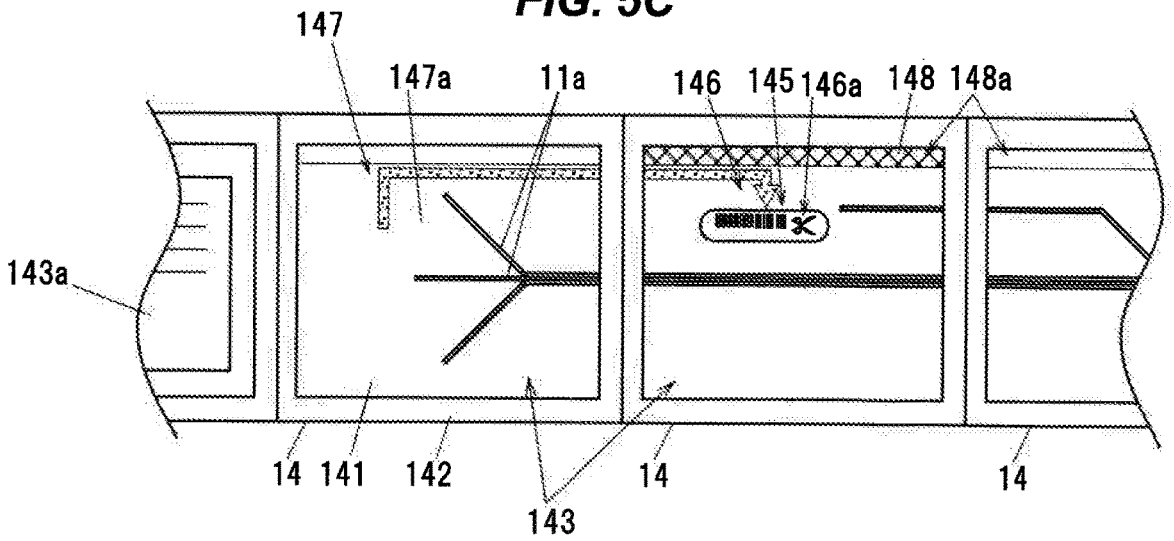

Although in the example of FIG. 5B, the linear shape arrow 147*a* is displayed from the displaying position for the erased wire laying out position indicator 145 to the displaying position for the next wire laying out position indicator 145, the present invention is not limited to the foregoing, but for example, as shown in FIG. 5C, the arrow 147*a* may be displayed in such a manner as to bypass the electric wire images 11*a* on the wire laying out drawing 143. Although in FIG. 5C, as one example, a case is shown in which the arrow 147*a* is displayed in such a manner as to be passed through the illustrated upper edge portion of the display devices 14, the shape, the path, and the like of the arrow 147*a* can be appropriately altered. The arrow 147*a* may be displayed with a color different from a background color of the wire laying out drawing 143 so that the operator can easily distinguish the color of the arrow 147*a* therefrom. Note that the guide indicator 147 is not limited to the arrow 147*a*, but that the guide indicator 147 may be, for example, one configured to display the numbers or the like of the display devices 14 with characters, and that the guide indicator 147 may be any indicator as long as it can indicate the displaying position for the next bar code 146 to the operator.

By displaying the guide indicator 147, for example, even when the next wire laying out position indicator 145 is displayed on the display device 14 away from the display device 14 with the operation currently being in progress thereon, the operator can intuitively recognize the position of the next wire laying out position indicator 145, which results in a contribution to an enhancement in operation efficiency. Note that the guide indicator 147 may be displayed only when the display device 14 with the wire laying out position indicator 145 to be erased being displayed thereon and the display device 14 with the next wire laying out position indicator 145 to be displayed thereon are different from each other.

Further, the displaying control section 161 of the control device 16 is configured in such a manner as to display an operation in progress indicator 148 on a predetermined region of the display device 14 with the wire laying out position indicator 145 being displayed thereon, with the operation in progress indicator 148 indicating that the wire laying out position indicator 145 is displayed on that display device 14. In the present embodiment, as shown in FIGS. 4A to 4C and 5A to 5C, the displaying control section 161 of the control device 16 is configured in such a manner as to display the operation in progress indicator 148 on operation in progress indicator regions 148*a*, which are set on the respective illustrated upper edge portions of the plurality of display devices 14. The operation in progress indicator 148 is displayed on the operation in progress indicator regions 148*a*, for example, with the operation in progress indicator regions 148*a* set to have a color different from that of the wire laying out drawing 143 (or with that different color set to blink).

By displaying the operation in progress indicator 148 on the display devices 14, the operator can easily recognize the display device 14 with the operation to be performed thereon, and thereby ensure the improvement of the operation efficiency. Further, by displaying the operation in progress indicator 148 on the display devices 14, for example, when the image of the work bench 15 is recorded by a monitoring camera in the factory, it is possible to easily identify the display device 14 with the operation currently being performed thereon, and it is therefore easy for the administrator to grasp the operation status.

In the present embodiment, the color of the operation in progress indicator 148 during the continuity checking operation, which will be described later, is made different from the color of the operation in progress indicator 148 during the other operations such as the wire laying out operation and the like. Further, character information indicating the continuity check (character information such as Check Conductivity or the like) is inserted into the operation in progress indicator 148 during the continuity checking operation (see FIG. 7). This is because the continuity checking operation is required to be performed at both the end portions of the electric wire 11 at the same time, and therefore each of the operators performing the operation at both the end portions of the electric wire 11 is required to recognize performing the continuity checking operation and promptly perform the operation.

In order to allow the operators to easily discriminate the electric wire images 11*a* of the electric wires 11 to be laid out, the displaying control section 161 of the control device 16 may be configured in such a manner as to display only the end portions of the electric wire images 11*a* to be laid out, or the entire electric wire images 11*a* to be laid out, with a color different from the colors of the other electric wire images 11*a*. Further, in order to allow the operators to easily recognize the branching positions of the electric wires 11, the displaying control section 161 of the control device 16 may be configured in such a manner as to display the colors of the branching portions of the electric wire images 11*a* to be laid out, with a color different from the colors of the other electric wire images 11*a*. Further, the displaying control section 161 of the control device 16 may be configured in such a manner as to display the color of each of the electric wires images 11*a* on the wire laying out drawing 143 with different colors before the wire laying out, during the wire laying out operation, and after the wire laying out.

The electric wire cutting control section 162 of the control device 16 is configured to control the electric wire feeding device 12 and the electric wire cutting machine 13, to perform a cutting control to cut each of those electric wires 11 to a designated length. The electric wire cutting control section 162 of the control device 16 is configured to retrieve the design value of the electric wire length of one of those electric wires 11 from the operation recipe information 172, and act to pull out the one of those electric wires 11 by a predetermined length with the transfer robot 125, and when the length of that pulled out electric wire 11 measured by the feeder becomes equal to the design value of the electric wire length in the operation recipe information 172, cut that pulled out electric wire 11 with the electric wire cutting machine 13. This results in those electric wires 11 having the lengths designated according to the design values of the electric wire lengths in the operation recipe information 172.

The printing control section 163 of the control device 16 is configured to print, with the two printers 18, the identification marks to be attached to the respective two end portions, respectively, of each of those electric wires 11. In the present embodiment, the two printers 18 are arranged on both the end portions, respectively, of the work bench 15, so as to attach the identification marks to the respective two end portions, respectively, of each of those electric wires 11. Further, in the present embodiment, the two printers 18 are used to print ring marks as the identification marks, respectively, and mark tapes with two-dimensional codes (QR codes (registered trademark)), respectively, thereon configured to be able to identify each of those electric wires 11. Note that the two code readers 19 and the two continuity checking testers 20 are also being provided so as to be able to perform the operation at the respective two ends, respectively, of each of those electric wires 11.

Figure 6:
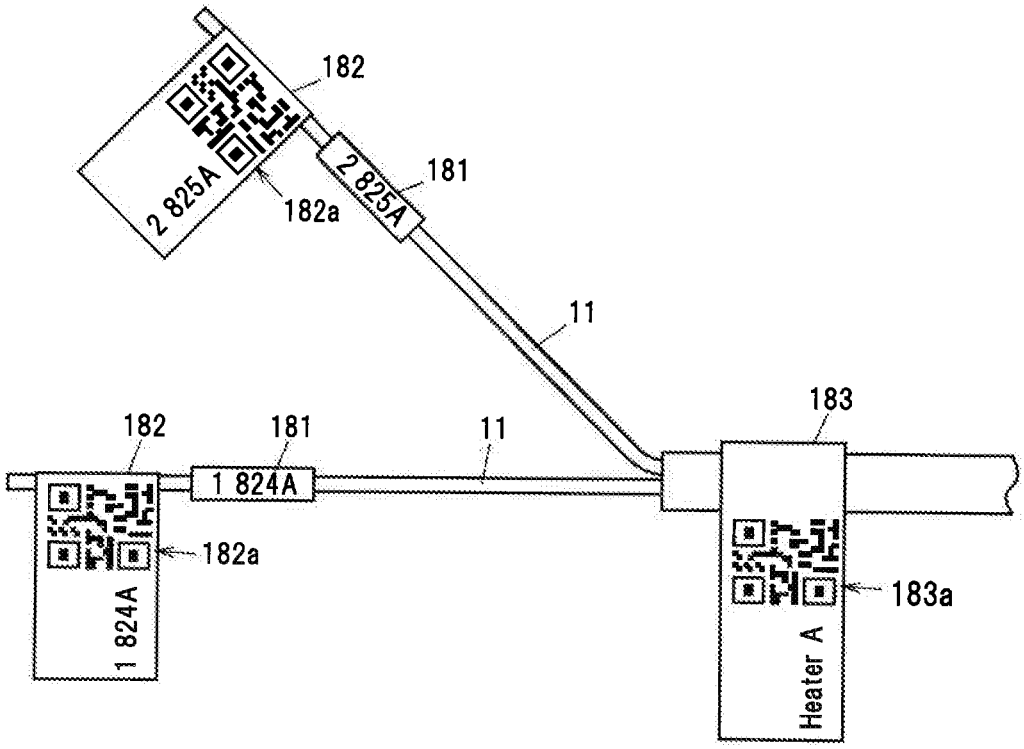
FIG. 6 is a diagram showing end portions of electric wires each being fitted with a ring mark and a mark tape thereon.

As shown in FIG. 6, the ring marks 181 and the mark tapes 182 printed by the two printers 18 are configured to be attached to the respective two end portions, respectively, of each of those electric wires 11. In the present embodiment, the mark tapes 182 are configured in such a manner that the two-dimensional codes 182*a* are printed on the mark tapes 182 respectively, but may be configured in such a manner that the bar codes are printed on the mark tapes 182 respectively. In addition, a vicinity of a branching portion of the electric wires 11 is fitted with an area label tape 183 which is configured to indicate an area (an area label in the operation recipe information 172) of a connection destination of the electric wires 11 extended out from that branching portion. As with the mark tapes 182, the area label tape 183 is configured in such a manner that a two-dimensional code 183*a* configured to be able to specify the area of the area label connection destination is printed on the area label tape 183. The mark tapes 182 and the area label tapes 183 are adhesive seals with the two-dimensional codes 182*a* and 183*aly* being printed thereon, and the mark tapes 182 and the area label tapes 183 are attached to each of the electric wires 11 in such a manner that their respective one parts are wrapped around each of the electric wires 11. The two-dimensional codes 182*a* on the mark tapes 182 are configured to be created from character information in the operation recipe information 172. Also, the two-dimensional codes 182*a* may be configured in such a manner as to include a plurality of pieces of information.

The ring marks 181 are a ring-shaped member, and are fitted on each of the end portions of the electric wires 11 by inserting each of the end portions of the electric wires 11 into an inner periphery of each of the ring marks 181 respectively. In the present embodiment, the inner diameters of the ring marks 181 are formed larger than the outer diameters of the electric wires 11, so that the ring marks 181 are movably fitted on each of the end portions of the electric wires 11 in longitudinal directions of each of the electric wires 11 respectively. Since the mark tapes 182 are located closer to the end portions of the electric wires 11 than the ring marks 181, the ring marks 181 movable in the longitudinal directions of the electric wires 11 are substantially prevented from slipping off the end portions of the electric wires 11 respectively.

Note that, in the present embodiment, the ring marks 181 and the mark tapes 182 are used as the identification marks, but that the ring marks 181 may be omitted while only the mark tapes 182 may be used as the identification marks. Further, it is naturally possible to use an IC tag, an RFID tag, or the like as the identification marks. Further, the information to be printed on the mark tapes 182, the ring marks 181, and the area label tapes 183 may be printed on an outer periphery of each of the electric wires 11 (on an outer periphery of the outer sheath of each of the electric wires 11).

The continuity checking section 164 of the control device 16 is configured to check the continuity of each of the electric wires 11 after laying out of each of the electric wires 11. The continuity checking section 164 of the control device 16 is configured to perform the continuity checking by bringing the probes of the two continuity checking testers 20 into contact with the conductor of each of the electric wires 11 at both the end portions of each of the electric wires 11 to obtain the conductor resistance of each of the electric wires 11, and make a decision as to whether the conductor resistance of each of the electric wires 11 is within a predetermined normal range. In the present embodiment, the continuity checking section 164 of the control device 16 is configured in such a manner as to display an indication of the continuity checking on the plurality of display devices 14 of the work bench 15 by means of the displaying control section 161 of the control device 16 after the laying out of each of the electric wires 11, and to erase the display of the indication of the continuity checking after continuity checking of each of the electric wires 11.

Figure 7:
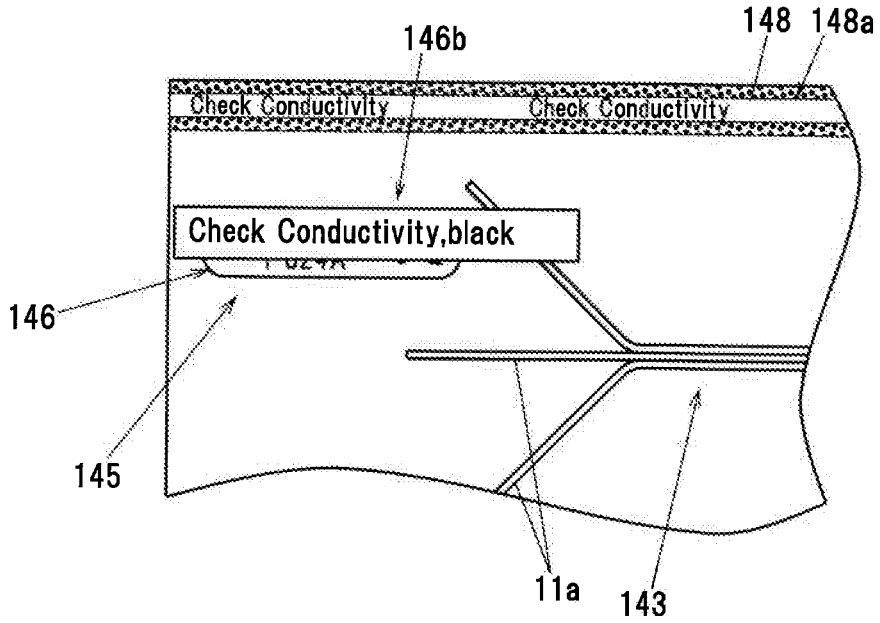
FIG. 7 is a diagram showing a display example during continuity checking operation.

As shown in FIG. 7, the continuity check indicator 146*b* is displayed in such a manner as to be partially superimposed on the bar codes 146 of the wire laying out position indicator 145, with the location of the wire laying out position indicator 145 being able to be identified by the operator, but with the bar codes 146 being unable to be read by the operator. This makes it possible to substantially prevent the operator from reading the bar codes 146 and progressing to the next step before the continuity checking. Further, since a part of the wire laying out position indicator 145 can be visually recognized by the operator, it is possible to smoothly perform the reading of the bar codes 146 after the continuity checking. In the present embodiment, a display such as a "Check Conductivity, black" is performed as the continuity check indicator 146*b*, so that it is possible to suppress the occurrence of an incorrect continuity checking by presenting the color of the electric wire 11 (the color of the outer sheath of the electric wire 11, herein, black) to be subjected to the continuity checking.

As shown in FIGS. 1 and 4A, the display device 14 being arranged closest to the reference end portion is configured to display a production information screen 143*a* with production information including the information on the wire harnesses to be produced, the information on the operator, the production procedure, and the like, to be displayed on that production information screen 143*a*, but with no images of the wire harnesses to be displayed on that production information screen 143*a*. The production information screen 143*a* may be configured as a part of the wire laying out image data 171 or may be configured in such a manner as to be created separately from the wire laying out image data 171.

Further, the control device 16 is configured to include a time recording section 165, which is configured to store a time at which the two bar codes 146 displayed on the plurality of display devices 14 have been read in by the two code readers 19, in the storing section 17 of the control device 16 as progress status administration information 173. The progress status administration information 173 is transmitted to an administrating server 21, which will be described later, and is used in the administration of the progress information.

Further, the control device 16 is configured to include a correspondence judging section 166 that is configured to make a decision as to whether the code information in the identification marks (the two-dimensional codes 182*a* on the mark tapes 182) read in by the two code readers 19, and the code information in the identification codes (the bar codes 146) displayed on the plurality of display devices 14 are in correspondence with each other. In the present embodiment, the code information in the two-dimensional codes 182*a* on the mark tapes 182 and the code information in the bar codes 146 displayed on the plurality of display devices 14 are configured to match each other, and the correspondence judging section 166 of the control device 16 is configured to make a decision as to whether the code information in the two-dimensional codes 182*a* on the mark tapes 182 read in by the two code readers 19, and the code information in the bar codes 146 displayed on the plurality of display devices 14 are matching each other.

The correspondence judging section 166 of the control device 16 is configured in such a manner that, as a result of the decision made by the correspondence judging section 166, if the code information in the two-dimensional codes 182*a* on the mark tapes 182 read in by the two code readers 19, and the code information in the bar codes 146 displayed on the plurality of display devices 14 are not matching each other, then the correspondence judging section 166 displays alert information on the plurality of display devices 14 by means of the displaying control section 161 of the control device 16. Note that the correspondence judging section 166 of the control device 16 may be configured in such a manner that, for example when the code information in the two-dimensional codes 182*a* on the mark tapes 182 read in by the two code readers 19, and the code information in the bar codes 146 displayed on the plurality of display devices 14 are not matching each other, the correspondence judging section 166 activates an alarm device configured to generate an alarm with sound or light or the like, and provided adjacent to the work bench 15.

The time recording section 165 of the control device 16 is equipped with a built-in clock function, and is configured to, each time one of the plurality of electric wires 11 is laid out, store a time at which the one of the plurality of electric wires 11 has been laid out, in the storing section 17 of the control device 16. In the present embodiment, the time recording section 165 of the control device 16 is configured to store a time at which the identification codes (the bar codes 146) have been read in by the two code readers 19, in the storing section 17 of the control device 16. The time recording section 165 of the control device 16 is configured in such a manner that, as a result of the decision made by the correspondence judging section 166 of the control device 16, when the correspondence judging section 166 has determined that the code information in the two-dimensional codes 182*a* on the mark tapes 182 read in by the two code readers 19, and the code information in the bar codes 146 displayed on the plurality of display devices 14 are matching each other, the time recording section 165 stores a time at which the bar codes 146 have been read in, in the storing section 17 of the control device 16 as the progress status administration information 173.

Note that the time at which the identification codes have been read in is not limited to the foregoing, but that the time at which the correspondence judging section 166 of the control device 16 has determined that the code information in the two-dimensional codes 182*a* on the mark tapes 182 read in by the two code readers 19, and the code information in the bar codes 146 displayed on the plurality of display devices 14 are matching each other may be stored as the time at which the identification codes have been read in. That is, the "time at which the identification codes have been read in" may not be strictly the time at which the identification codes have been read in, but the time at which the predetermined decision processing or the like resulting from the identification codes having been read in (in the present embodiment, the processing which determines that the code information in the two-dimensional codes 182*a* on the mark tapes 182 read in by the two code readers 19, and the code information in the bar codes 146 displayed on the plurality of display devices 14 are matching each other) has ended, may be stored as the "time at which the identification codes have been read in".

Further, the time recording section 165 of the control device 16 may be configured in such a manner that, when as described above, the plurality of display devices 14 are configured with the touch panel and the touch operation for the wire laying out position indicators 145 is set as the trigger for the operation start or the operation finish, the time recording section 165 stores the time at which the wire laying out position indicators 145 have been touched, in the storage section 17 of the control device 16.

Further, the wire harness producing device 10 is configured to include an administrating server 21, which is provided in such a manner as to be able to communicate with the control device 16. Only one control device 16 is shown in FIG. 1, but in practice, on each of production lines (the respective work bench 15 of each of the production lines), the respective control device 16 thereof is provided, and the administrating server 21 is provided in such a manner as to be able to communicate with the respective control device 16 of each of the production lines.

The administrating server 21 is configured to perform the creation of the wire laying out image data and the administration of the progress information, and is configured as an appropriate combination of a computing element, a memory, an interface, a hard disk, a software and the like. The storage section 22 of the administrating server 21 is configured to store the wire laying out image data 171 and the operation recipe information 172 of all types of the wire harnesses to be produced within a factory. The administrating server 21 is configured to transmit to the respective control device 16 of each one of the production lines the wire laying out image data 171 and the operation recipe information 172 of the wire harnesses allocated to that one of the production lines.

The administrating server 21 is configured to include a progress status administrating section 211. The progress status administrating section 211 of the administrating server 21 is configured to act to retrieve the time at which the identification codes have been read in, in other words, the progress status administration information 173, having been stored in the storage section 17 of the control device 16, and store that retrieved progress status administration information 173 in the storage section 22 of the administrating server 21, while acting to obtain a progress status of the production of the wire harness on the basis of that retrieved progress status administration information 173, and display that obtained progress status on an administrating display 23. In the present embodiment, a monitor attached to the administrating server 21 is used as the administrating display 23, but a monitor provided separately from the administrating server 21, such as a large-screen monitor provided in the factory or the like, may be used as the administrating display 23.

More specifically, the progress status administrating section 211 of the administrating server 21 is configured to, on the basis of the progress status administration information 173, obtain the number of the laid out electric wires 11, the number of the unlaid out electric wires 11, the proportion of the number of the laid out electric wires 11 to the total number of the electric wires 11 to be laid out, a preset standard operating time (target operating time), an elapsed time from the start of the operation, and the like on each of the production lines, and display them on the administrating display 23 as a progress status display screen.

Figure 8:
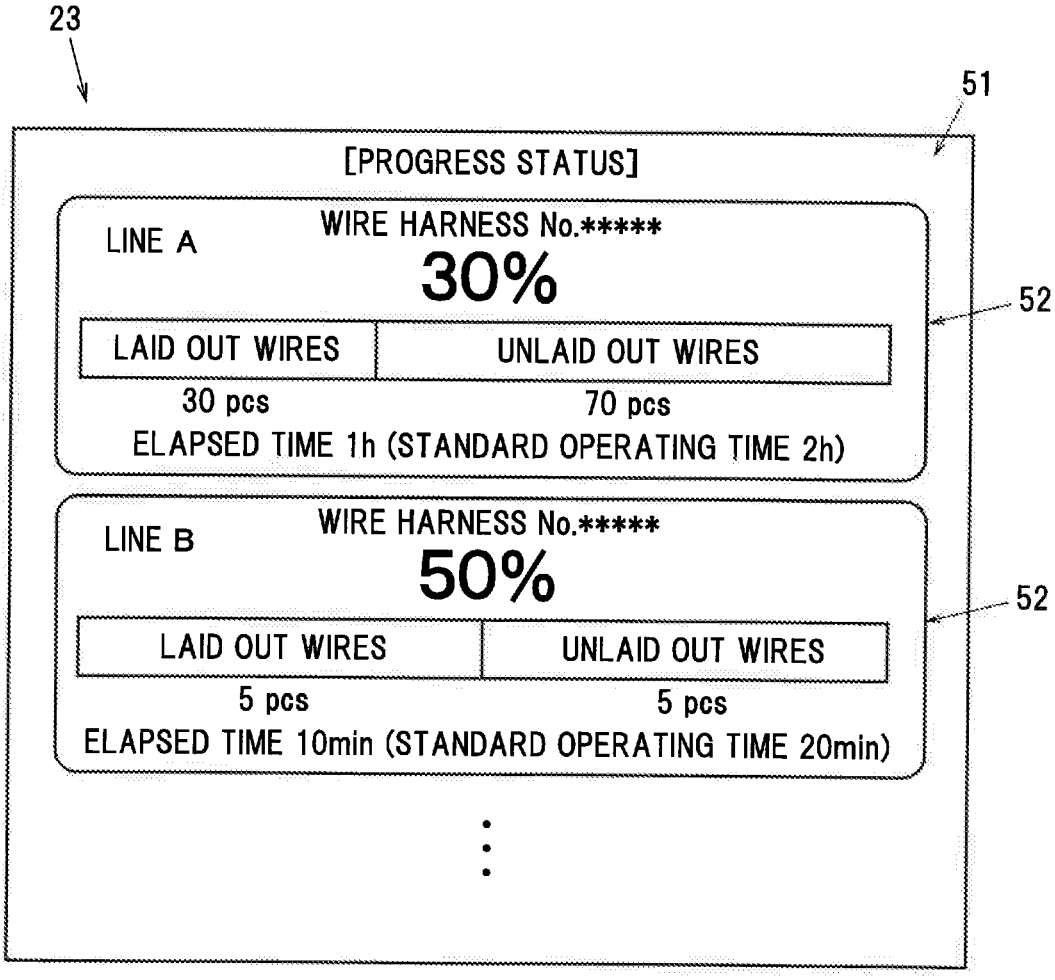
FIG. 8 is a diagram showing one example of a progress status display screen.

FIG. 8 shows one example of the progress status display screen 51. As shown in FIG. 8, the progress status display screen 51 is configured in such a manner as to display the respective progress status of each of the production lines of the factory, for example. Herein, as one example, a case is shown in which respective individual progress status displaying sections 52 of the two production lines A and B are displayed, but the number of the production lines to be displayed is not limited to the above number. Also, for the display form of each of the individual progress status displaying sections 52, various display forms can be adopted, for example by using a bar graph or a pie chart or the like to display the progress statuses. The respective display contents of each of the individual progress status displaying sections 52 are also not limited to those shown in FIG. 11, but can appropriately be configured, for example by displaying the proportion of the elapsed time to the standard operating time (target operating time), or the like.

(Control Flow in the Respective Control Device 16 of Each One of the Production Lines)

Figure 9:
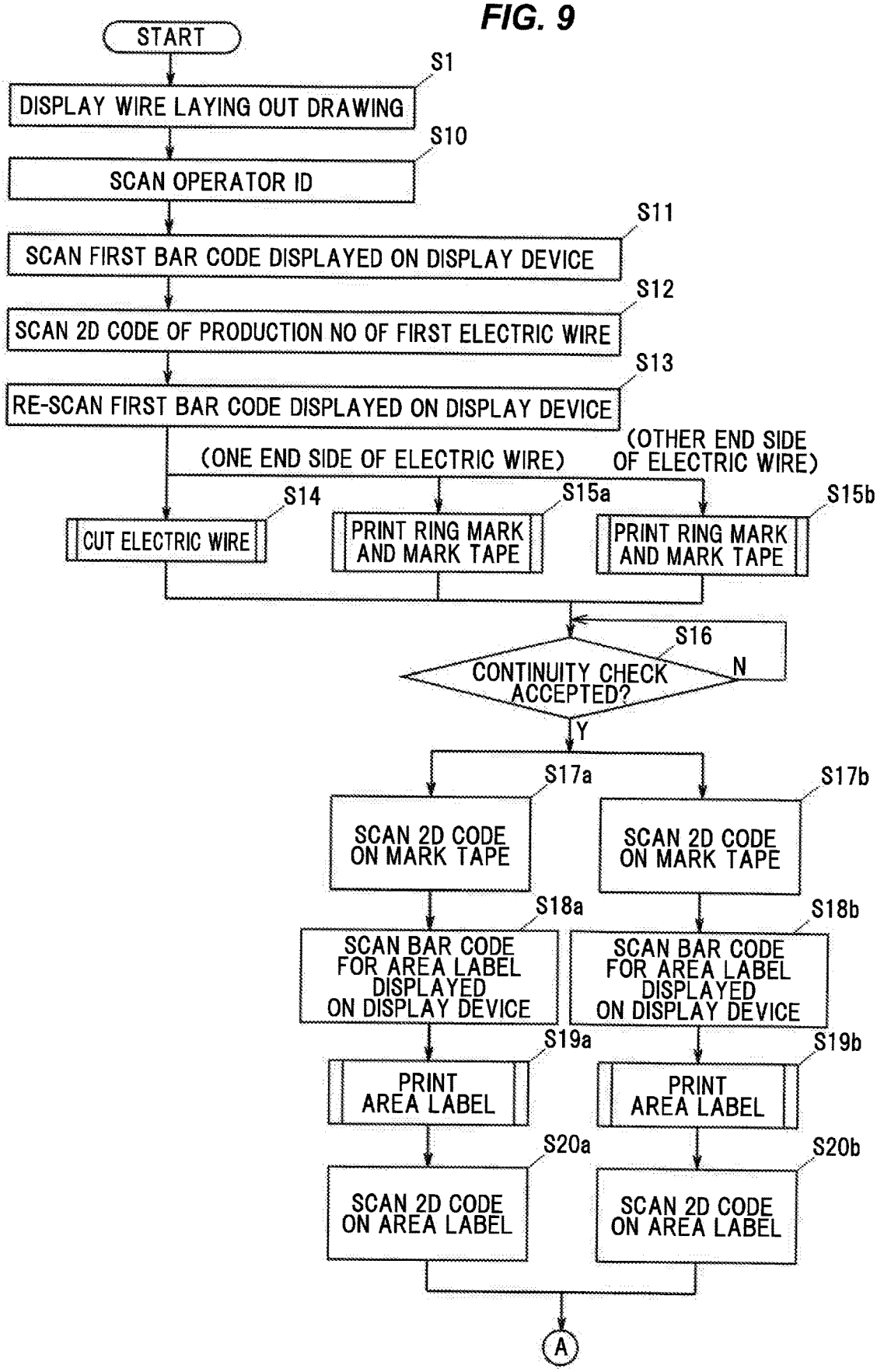
FIG. 9 is a flow chart showing a procedure for producing a wire harness.
Figure 10:
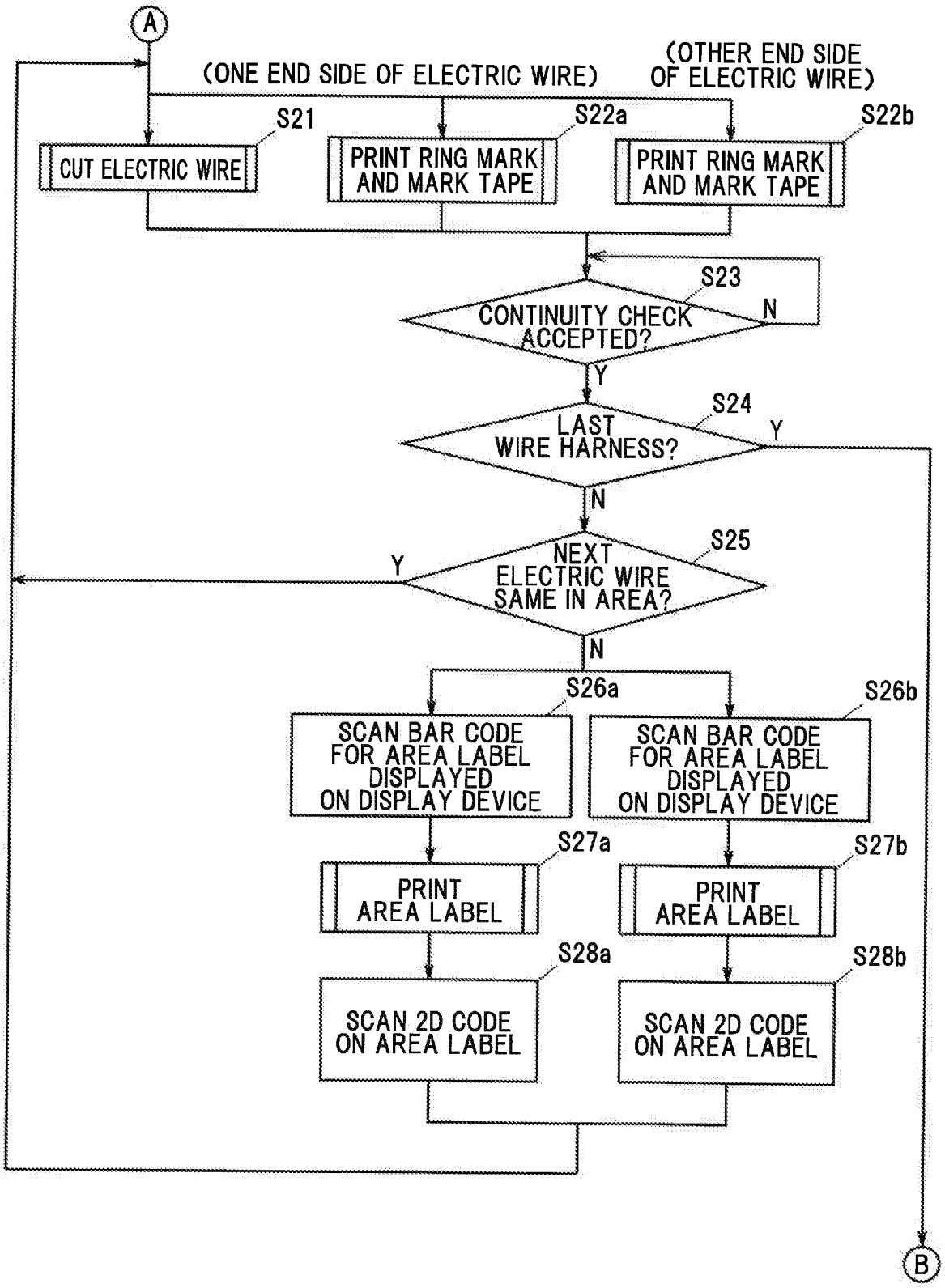
FIG. 10 is a flow chart showing a procedure for producing the wire harness.
Figure 11:
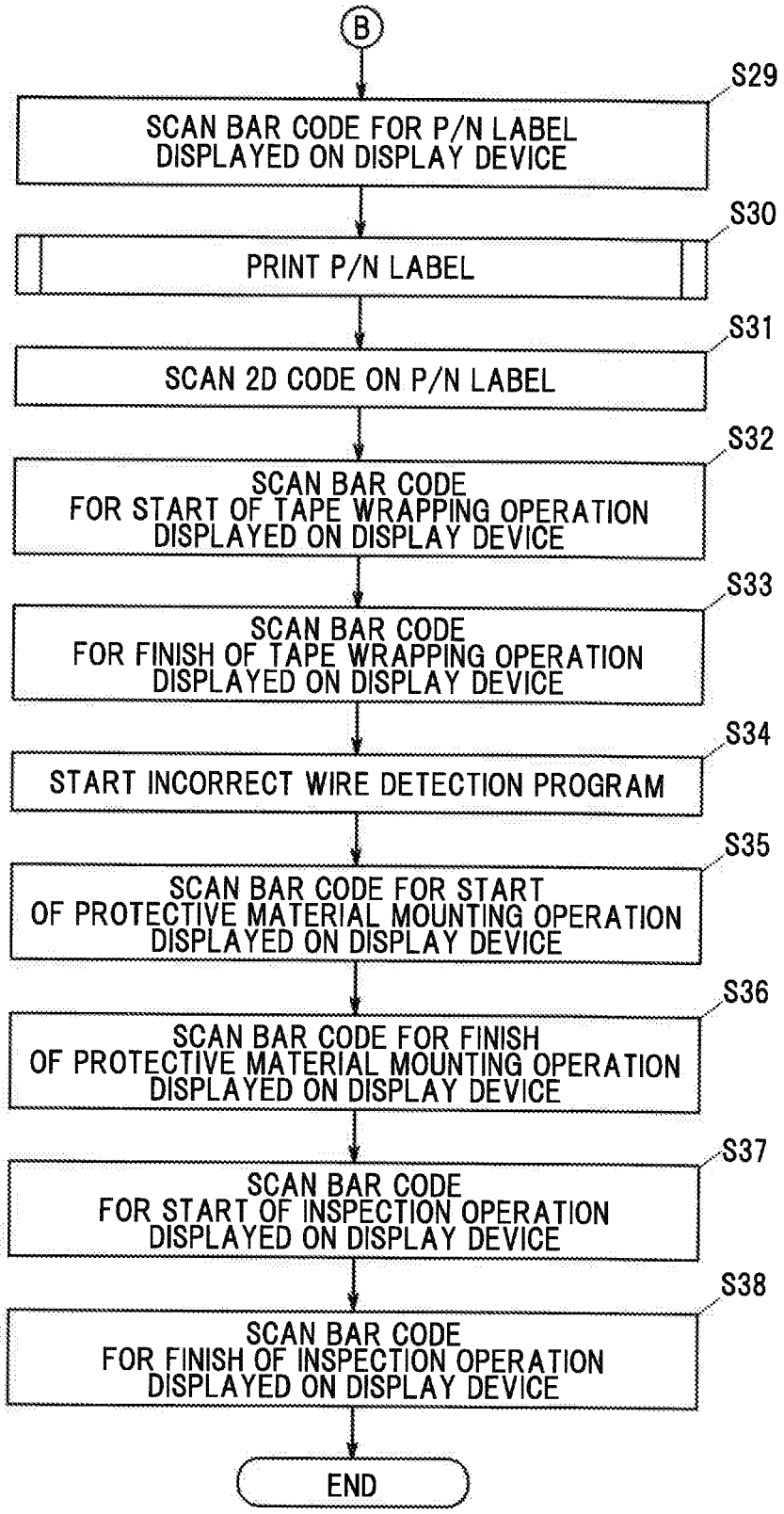
FIG. 11 is a flow chart showing a procedure for producing the wire harness.

FIGS. 9 to 11 are flow charts showing a procedure for producing the wire harness.

As shown in FIGS. 9 to 11, first, the displaying control section 161 of the respective control device 16 of each one of the production lines displays the wire laying out drawing 143 on the plurality of display devices 14 on the basis of the wire laying out image data 171 stored in the storage section 17 of the control device 16. After that, in step S10, operators IDs are scanned with the two code readers 19, respectively. The operators IDs each refer to a code allocated to each one of the operators to identify that one of the operators, and are each being displayed on, for example a name tag or the like as a bar code. The information on the scanned operators IDs are stored in the storage section 17 of the respective control device 16 of that one of the production lines. At this point of time, the displaying control section 161 of the control device 16 may be configured in such a manner as to display an indication of reading in the operators IDs on the plurality of display devices 14 of that one of the production lines. In this case, the displaying control section 161 displays the operation in progress indicator 148 on the display devices 14 with the indication of reading in the operators IDs, respectively, being displayed thereon. When the operators IDs are scanned, the displaying control section 161 of the control device 16 displays the two wire laying out position indicators 145 including thereon the two bar codes 146 of the electric wire 11 to be first laid out on the plurality of display devices 14. The two wire laying out position indicators 145 are displayed adjacent to both the end portions, respectively, of that electric wire 11 to be laid out. The displaying control section 161 displays the operation in progress indicator 148 on the display devices 14 with the two wire laying out position indicators 145, respectively, being displayed thereon.

After that, in step S11, the operators scan the first bar codes 146 (the bar codes 146 being included in the first two wire laying out position indicators 145) displayed on the plurality of display devices 14. After that, in step S12, the two-dimensional code of the production number of that electric wire 11 to be first laid out is scanned. Specifically, the electric wire identification code attached to the reel 121 is read in with the two code readers 19. The displaying control section 161 of the control device 16 may be configured in such a manner that, at this point of time, if the production number of that electric wire 11 included in the information in the electric wire identification code is not matching the production number of that electric wire 11 in the operation recipe information 172, then that displaying control section 161 displays a reel replacement indication on the plurality of display devices 14, for example.

After that, in step S13, when the first bar codes 146 displayed on the plurality of display devices 14 are scanned again, in step S14, the electric wire cutting control section 162 of the control device 16 controls the electric wire feeding device 12 and the electric wire cutting machine 13, and cuts the nth electric wire 11 to the electric wire length set in the operation recipe information 172. In addition, in parallel with step S14, in steps S15*a* and S15*b*, the ring marks 181 and the mark tapes 182 are printed with the two printers 18 at both one end side and the other end side of that electric wire 11. The operators use, as markers, the wire laying out image data 171 and the bar codes 146 displayed on the plurality of display devices 14, and arrange that cut electric wire 11 while attaching the ring marks 181 and the mark tapes 182 to both the end portions of that electric wire 11.

After that, in step S16, a continuity checking is performed. The displaying control section 161 of the control device 16 displays the operation in progress indicator 148 for the continuity checking. Further, the continuity checking section 164 of the control device 16 displays the continuity check indicator 146*b* on the plurality of display devices 14 by means of that displaying control section 161 (see FIG. 7). The operators bring the probes of the two continuity checking testers 20 into contact with the conductor of that electric wire 11 at both the end portions, respectively, of that electric wire 11. The continuity checking section 164 of the control device 16 computes the electric conductivity of that electric wire 11 on the basis of the outputs of the two continuity checking testers 20, and if the computed electric conductivity of that electric wire 11 falls within a predetermined normal value range, then an acceptance decision is made as a result of the continuity checking. The continuity checking section 164 of the control device 16 may be configured in such a manner that if a rejection decision is made as a result of the continuity checking, then that continuity checking section 164 displays alert information on the plurality of display devices 14 by means of the displaying control section 161 of the control device 16. If that rejection decision is made in the continuity checking, then the flow returns to step S16 to perform the continuity checking. Further, the continuity checking section 164 of the control device 16 may be configured in such a manner that if that rejection decision is repeatedly made a predetermined number of times in the continuity checking in step S16, then the flow returns to step S13, to redo the laying out of the first electric wire 11 to be laid out. In this case, that electric wire 11 having been rejected in the continuity checking is discarded.

After that acceptance decision has been made in the continuity checking in step S16, a scanning of the two-dimensional codes 182*a* on the mark tapes 182 attached to both the end portions, respectively, of that electric wire 11 (steps S17*a* and S17*b*) and a scanning of the bar codes 146 for an area label displayed on the plurality of display devices 14 (steps S18*a* and S18*b*) are performed at each of both the end portions of that electric wire 11, followed by a printing of the area label tapes 183 being performed by the two printers 18 (steps S19*a* and S19*b*). So, the operators attach those area label tapes 183 to predetermined places on that electric wire 11 and subsequently scan the two-dimensional codes 183*a* on those area label tapes 183 (steps S20*a* and S20*b*). By performing the above steps, the wire laying out operation for the first electric wire 11 is completed.

After that, in step S21, a cutting of the electric wire 11 to be next laid out is performed, while in steps S22*a* and 22*b*, a printing of the ring marks 181 and the mark tapes 182 of that electric wire 11 is performed. In addition, at this point of time, the bar codes 146 are displayed adjacent to both the end portions of that electric wire 11 to be laid out. The operators use, as markers, the wire laying out image data 171 and the bar codes 146 displayed on the plurality of display devices 14, and arrange that cut electric wire 11 while attaching the ring marks 181 and the mark tapes 182 to both the end portions of that electric wire 11. After that, in step S23, a continuity checking is performed. If a rejection decision is made as a result of the continuity checking, then the flow returns to step S23 to perform the continuity checking.

If an acceptance decision is made as a result of the continuity checking in step S23, then, in step S24, the control device 16 looks up the operation recipe information 172 and makes a decision as to whether that electric wire 11 having been subjected to the continuity checking is the last electric wire 11 to be laid out. If a Yes decision is made in step S24, then the flow progresses to step S29.

If a No decision is made in step S24, then, in step S25, the control device 16 looks up the operation recipe information 172, and makes a decision as to whether the next electric wire 11 to be laid out is the same in the area (the same in the area label) as that electric wire 11 currently being laid out, that is, that electric wire 11 having been subjected to the continuity checking in step S23. If a Yes decision is made in step S25, then the flow returns to steps S21, S22*a*, and S22*b*, to perform the wire laying out operation for the next electric wire 11.

If a No decision is made in step S25, then the displaying control section 161 of the control device 16 displays the bar codes 146 for the area label adjacent to both the end portions, respectively, of that electric wire 11 on the plurality of display devices 14. The operators perform a scanning of those bar codes 146 for the area label displayed on the plurality of display devices 14, at each of both the end portions of that electric wire 11 (Steps S26*a* and S26*b*), followed by a printing of the area label tapes 183 being performed by the two printers 18 (steps S27*a* and S27*b*). So, the operators attach those area label tapes 183 to predetermined places on that electric wire 11 and subsequently scan the two-dimensional codes 183*a* on those area label tapes 183 (steps S28*a* and S28*b*). After that, the flow returns to steps S21, S22*a*, and S22*b*, to perform the wire laying out operation for the next electric wire 11.

After finishing the wire laying out of all the electric wires 11, in step S29, the operators scan bar codes for a P/N label displayed on the plurality of display devices 14. Note that, prior to step S29, the displaying control section 161 of the control device 16 displays the bar codes for the P/N label on the plurality of display devices 14. When the operators have scanned the bar codes for the P/N label, the P/N labels are printed by the two printers 18 in step S30. Note that the P/N labels are a label configured to indicate a production number (a part number) of the wire harness, and to include a production number, a product name, a drawing number, and the like included in the operation recipe information 172 being printed on that label as character information and a two-dimensional code. Since the P/N labels are used to identify the entire wire harness, the P/N labels are attached to a trunk portion of the wire harness. After having attached the P/N labels to predetermined places on the wire harness, the operators scan the two-dimensional codes on the P/N labels in step S31.

After that, the displaying control section 161 of the control device 16 displays bar codes for start of a tape wrapping operation on the plurality of display devices 14. The operators scan the bar codes for start of the tape wrapping operation displayed on the plurality of display devices 14 in step S32. At this point of time, the positions for the tape wrapping are displayed on the plurality of display devices 14. The positions for the tape wrapping are indicated by a color or a frame or the like, for example. Further, the displaying control section 161 of the control device 16 displays bar codes for finish of the tape wrapping operation on the plurality of display devices 14. After having performed the tape wrapping operation, the operators scan the bar codes for finish of the tape wrapping operation in step S33.

When the operators have scanned the bar codes for finish of the tape wrapping operation, an incorrect electric wire detection program (Incorrect wire detection program) is started in step S34. The incorrect electric wire detection program is a program, which is configured to check whether the operating time is excessively short or long in comparison to the preset standard operating time, and check an incorrect operating order or an operation skipping, on the basis of the operation history information (the progress status administration information 173).

After that, the displaying control section 161 of the control device 16 displays bar codes for start of a protective material mounting operation on the plurality of display devices 14. The operators scan the bar codes for start of the protective material mounting operation displayed on the plurality of display devices 14 in step S35. At this point of time, the positions for the protective material mounting are displayed on the plurality of display devices 14. The positions for the protective material mounting are indicated by, for example, a color or a frame or the like. Further, the displaying control section 161 of the control device 16 displays bar codes for finish of the protective material mounting operation on the plurality of display devices 14. After having performed the protective material mounting operation, the operators scan the bar codes for finish of the protective material mounting operation in step S36.

After that, the displaying control section 161 of the control device 16 displays bar codes for start of an inspection operation on the plurality of display devices 14. The operators scan the bar codes for start of the inspection operation displayed on the plurality of display devices 14 in step S37. After having performed the predetermined inspection operation, the operators scan bar codes for finish of the inspection operation in step S38. By performing the above steps, the wire harness is produced, and the wire laying out step is completed.

The times at which the bar codes 146, or the two-dimensional codes, or the like have been scanned in each of the above steps, are stored in the storage section 17 of the control device 16 as the progress status administration information 173, by the time recording portion 165. The progress status administrating section 211 of the administrating server 21 is configured to appropriately update the progress information on the progress status display screen 51 on the basis of the progress status administration information 173 having been stored in the storage section 17 of the control device 16. For example, the progress status administrating section 211 of the administrating server 21 may be configured in such a manner as to update the progress information every time the bar codes 146 or the two-dimensional codes or the like have been scanned, or may be configured in such a manner as to update the progress information at appropriate time intervals.

Further, the operation history information may be configured in such a manner as to be created and stored on the basis of the progress status administration information 173 having been stored in the storage section 17 of the control device 16 or the storage section 22 of the administrating server 21. The operation history information refers to a data log configured to include the histories of the operations and the times taken for the operations summarized therein. For example, as shown in FIG. 12, the operation history information 174 is configured to include a Side for indicating a position of an end portion and denoting a connection destination area (e.g., a connection destination device or the like), an Item/Operation for denoting the electric wires 11 or the contents of the operations, a Date for denoting the times, an Additional Info for indicating details of the contents of the operations or the like, a length for denoting the electric wire lengths, the contents of the scans such as start/finish/check or the like, or a Scanned for denoting the results of the electric conductivity measurement in the continuity checking, a Time for denoting the operating times, and information such as More Info or the like for denoting other additional information. In FIG. 12, a Part Number denotes the production number of the wire harness, a Start denotes the production start time of the wire harness, a Finish denotes the production finish time of the wire harness, Operators denote the operators IDs, and a Total denotes the time taken to produce the wire harness. Note that the information included in the operation history information 174 can be altered as appropriate.

(Actions and Advantageous Effects of the Embodiment)

As described above, in the wire harness producing device 10 according to the present embodiment, the operation recipe information 172 is configured to include the coordinate information indicating the two displaying positions for the wire laying out position indicators 145, and the displaying control section 161 of the control device 16 is configured to display the wire laying out position indicators 145 in the two displaying positions respectively indicated by the coordinate information on that plurality of display devices 14.

As a result, it is possible to set the displaying positions for the wire laying out position indicators 145 for each one of the electric wires 11 to be laid out, for example display the wire laying out position indicators 145 at the positions adjacent to the end portions respectively of that one of the electric wires 11 to be laid out. The operators can perform the wire laying out of the electric wires 11 by using the displaying positions for the wire laying out position indicators 145 as a guide, thereby being able to greatly improve the operation efficiency in performing the wire laying out operation and the like while being able to suppress the occurrence of an incorrect wire laying out. Since the wire harness designed to be used in a train vehicle such as a train or the like is constituted by using a large number of the electric wires, by altering the displaying positions for the wire laying out position indicators 145 for each of the electric wires 11 to be laid out so as to properly navigate the operators, it is possible to highly efficiently perform the wire laying out operation and the like, and it is therefore possible to efficiently produce the wire harness. Further, since the wire laying out position indicators 145 (in other words, the operation indications) are displayed in accordance with the wire laying out order set in the operation recipe information 172, the operation order is standardized, thereby being able to ensure the improvement of the operation efficiency, regardless of the experience or skill of the operator.

(Summary of the Embodiment)

Next, the technical ideas grasped from the above-described embodiments will be described with the aid of the reference characters and the like in the embodiments. It should be noted, however, that each of the reference characters and the like in the following descriptions is not to be construed as limiting the constituent elements in the appended claims to the members and the like specifically shown in the embodiments.

[1] A wire harness producing device (10), which is configured to produce a wire harness by displaying a wire laying out drawing (143) in a full size in a length direction on a plurality of display devices (14), and laying out electric wires (11) along the wire laying out drawing (143), the device (10) comprising a displaying control section (161) configured to look up operation recipe information (172) configured as a database capable of identifying wire laying out order numbers of the electric wires (11), and in turn display wire laying out position indicators (145) configured to indicate positions of the electric wires (11) to be laid out, on the plurality of display devices (14), in accordance with a wire laying out order of the electric wires (11), with the operation recipe information (172) including coordinate information for indicating displaying positions for the wire laying out position indicators (145), with the displaying control section (161) configured to display the wire laying out position indicators (145), in the displaying positions indicated by the coordinate information on the plurality of display devices (14).

[2] The wire harness producing device (10) as defined in [1] above, wherein the operation recipe information (172) includes two pieces of the coordinate information of vicinities of respective two end portions of the electric wires (11) to be laid out, with the displaying control section (161) configured to display the wire laying out position indicators (145), in the displaying positions indicated by the two pieces of the coordinate information, respectively, on the plurality of display devices (14).

[3] The wire harness producing device (10) as defined in [1] or [2] above, wherein the wire laying out position indicators (145) include identification codes (146) of the electric wires (11) to be laid out, respectively.

[4] The wire harness producing device (10) as defined in [3] above, further comprising a time recording section (165) configured to store, in a storage section (17), times at which the identification codes (146) respectively have been read.

[5] The wire harness producing device (10) as defined in any one of [1] to [3] above, wherein the plurality of display devices (14) are each configured with a touch panel, and a time recording section (165) is included to store, in a storage section (17), times at which the wire laying out position indicators (145) respectively have been touched.

[6] The wire harness producing device (10) as defined in any one of [1] to [5] above, wherein the displaying control section (161) is configured to, when switching the wire laying out position indicators (145), erase a current one of the wire laying out position indicators (145) while displaying a next one of the wire laying out position indicators (145), and displaying a guide indicator (147) for indicating to an operator a displaying position for the next one of the wire laying out position indicators (145).

[7] The wire harness producing device (10) as defined in [6] above, wherein the guide indicator (147) is composed of an arrow (147*a*) extending from a displaying position for the erased one of the wire laying out position indicators (145) to a displaying position for the next one of the wire laying out position indicators (145).

[8] The wire harness producing device (10) as defined in any one of [1] to [7] above, wherein the displaying control section (161) is configured to display an operation in progress indicator (148) on a predetermined region of the plurality of display devices (14) with the wire laying out position indicators (145) being displayed thereon, with the operation in progress indicator (148) indicating that the wire laying out position indicators (145) are displayed on that plurality of display devices (14).

[9] The wire harness producing device (10) as defined in any one of [1] to [8] above, wherein the wire laying out position indicators (145) include thereon an icon (146*a*) indicating an operation content, respectively.

Although the embodiments of the present invention have been described above, the above described embodiments are not to be construed as limiting the inventions according to the appended claims. Further, it should be noted that not all the combinations of the features described in the embodiments are indispensable to the means for solving the problem of the invention. Further, the present invention can be appropriately modified and implemented without departing from the spirit thereof.

For example, although in the above-described embodiment, the display devices 14 with the operation being in progress thereon (the display devices 14 with the bar codes 146 being displayed thereon) can be specified with the operation in progress indicator 148, the present invention is not limited to the foregoing, but the display devices 14 with the operation being in progress thereon may be able to be specified, for example by making the display devices 14 with the operation being in progress thereon high (bright) in brightness, while making the display devices 14 with no operation being in progress thereon low (dark) in brightness. Further, the display devices 14 with the operation being in progress thereon may be specified by allowing a light emitting device such as an LED provided on each of the display devices 14 to emit light.

Further, although in the above-described embodiment, a case in which the wire harness designed for the train vehicle is produced has been described, the present invention is not limited to the above case, but can also produce the wire harness designed for a use application other than for the train vehicle.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A wire harness assembly device comprising a plurality of display devices, the plurality of display devices are configured to display a wire laying out drawing in a full size in a length direction on the plurality of display devices, and to produce a wire harness by laying out electric wires along the wire laying out drawing, the wire harness assembly device comprising;

a display control section of a control device configured to read from a memory, operation recipe information database, and a bar code reader reads identification codes and identifies wire laying out order numbers of the electric wires, and in turn, display a wire laying out position indicator that indicates positions of the electric wires to be laid out on the plurality of display devices, in accordance with a wire laying out order of the electric wires, with the operation recipe information including coordinate information for indicating displaying positions for the wire laying out position indicators, and the display control section configured to display the wire laying out position indicators in the displaying positions indicated by the coordinate information on the plurality of display devices, wherein the display control section, when switching the wire laying out position indicators, erases a current one of the wire laying out position indicators while displaying a next one of the wire laying out position indicators, and displays a guide indicator for indicating to an operator a displaying position for the next one of the wire laying out position indicators.

2. The wire harness assembly device according to claim 1, wherein the operation recipe information includes X and Y coordinate information of respective two end portions of the electric wires to be laid out, and the display control section configured to display the wire laying out position indicators, in the displaying positions indicated by the coordinate information, respectively, on the plurality of display devices.

3. The wire harness assembly device according to claim 1, wherein the wire laying out position indicators include the identification codes of the electric wires to be laid out, respectively.

4. The wire harness assembly device according to claim 3, further comprising: a time recording section of the control device configured to store, in a storage section, times at which the identification codes respectively have been read by a bar code reader.

5. The wire harness assembly device according to claim 1, wherein the plurality of display devices have a touch panel, and include a time recording section to store, in a storage section, times at which the wire laying out position indicators respectively have been touched.

6. The wire harness assembly device according to claim 1, wherein the guide indicator is composed of an arrow extending from a displaying position for the erased one of the wire laying out position indicators to a displaying position for the next one of the wire laying out position indicators.

7. The wire harness assembly device according to claim 1 wherein the display control section displays an operation in progress indicator on a predetermined region of the plurality of display devices with the wire laying out position indicators being displayed thereon, with the operation in progress indicator indicating that the wire laying out position indicators are displayed on that plurality of display devices.

8. The wire harness assembly device according to claim 1, wherein the wire laying out position indicators include thereon an icon indicating an operating status, respectively.

* * * * *